US005699820A

United States Patent [19]

Evans et al.

[11] Patent Number: 5,699,820

[45] Date of Patent: Dec. 23, 1997

[54] OUTDOOR SLEEPING SYSTEM WITH DETACHABLE SLEEPING BAG

[76] Inventors: David L. Evans; Dena K. Evans, both of 7956 Thompson Creek Rd., Applegate, Oreg. 97530

[21] Appl. No.: 613,288

[22] Filed: Mar. 11, 1996

[51] Int. Cl.[6] ..... A47G 9/00

[52] U.S. Cl. ..... 135/96; 135/87; 135/137; 135/116; 135/120.1; 52/2.22; 5/413 R; 5/413 AM

[58] Field of Search ..... 5/413 R, 413 AM, 5/414; 135/87, 96, 124, 137, 116, 120.1; 52/2.11, 2.17, 2.22, 2.25

[56] References Cited

U.S. PATENT DOCUMENTS

| | | | |
|---|---|---|---|
| 2,907,056 | 10/1959 | Kaplan . | |
| 2,931,373 | 4/1960 | Larson . | |
| 3,751,741 | 8/1973 | Hendry | 5/413 AM |
| 3,840,919 | 10/1974 | Middleton | 5/413 AM |
| 4,575,884 | 3/1986 | Jamerson et al. . | |
| 4,590,956 | 5/1986 | Griesenbeck | 135/116 |
| 4,605,029 | 8/1986 | Russell . | |
| 4,607,655 | 8/1986 | Wagner et al. . | |
| 4,719,935 | 1/1988 | Gustafson . | |
| 5,005,235 | 4/1991 | Huang | 5/413 R |
| 5,033,135 | 7/1991 | Creek | 5/413 R |
| 5,033,497 | 7/1991 | Hernandez . | |
| 5,240,021 | 8/1993 | Snodgrass | 135/116 X |
| 5,502,927 | 4/1996 | Hammerton | 135/116 X |
| 5,560,056 | 10/1996 | Tai | 5/413 AM X |
| 5,562,115 | 10/1996 | Sotelo | 135/116 X |

FOREIGN PATENT DOCUMENTS

| | | | |
|---|---|---|---|
| 0979852 | 1/1965 | United Kingdom | 5/413 AM |

*Primary Examiner*—Wynn E. Wood

*Attorney, Agent, or Firm*—Kolisch, Hartwell, Dickinson, McCormack & Heuser

[57] ABSTRACT

A portable outdoor sleeping system is provided which includes a shelter portion, a detachable ground cover sheet, and one or more detachable sleeping bags. Each sleeping bag includes an elongate perimeter flap to which a fastener element is fixed for use in detachable securement of the sleeping bag to a fastener element of a corresponding sleeping bag outline flap. The sleeping bag outline flap defines a predetermined sleeping bag placement position such that other portions of the ground cover sheet may be reserved for a different use. The system also includes an inflatable cushion which has a projecting strip for use in securing the cushion to the floor.

5 Claims, 2 Drawing Sheets

OUTDOOR SLEEPING SYSTEM WITH DETACHABLE SLEEPING BAG

TECHNICAL FIELD

The present invention relates generally to outdoor sleeping systems, and more particularly to a portable shelter which includes one or more built-in, detachable sleeping bags. Although the invention has broad utility, it is believed to be particularly useful in the context of a tent-like shelter of the type used when backpacking or camping, and is described in that context below.

BACKGROUND ART

Outdoor enthusiasts have, for many years, used tents and tent-like shelters to protect themselves and their belongings from the effects of the weather when camping or otherwise staying in the out-of-doors. These shelters have also served to protect campers from wildlife and insects, and have provided a moisture barrier between shelter contents and the ground. All of those functions are important to an enjoyable camping experience.

Although generally useful, most conventional shelters have been designed to assume the harshest of conditions, and thus have been poorly suited for use where more desirable weather conditions exist. Known tents, for example, generally have been of unitary construction, including a floor permanently secured to a dome-like roof which provides cover for the floor. Because the roof and floor are permanently joined, the roof can be used only in connection with the floor, and the floor only in connection with the roof. This arrangement, it will be appreciated, may be undesirable where the weather is particularly good. Under such conditions, a camper may wish to experience true open-air sleeping, but still desire a moisture barrier between himself/herself and the ground. Heretofore, campers have had to carry a separate canvas or mat for use when shelter from the elements is unnecessary. This in turn has added to the bulk and weight which a camper must carry, a situation which has proven particularly undesirable to backpackers and hikers. Known shelter arrangements thus have failed to provide the diversity which many campers seek.

Another problem with conventional shelters concerns the necessity of carrying separate pillows and sleeping bags, a necessity which similarly adds to the bulk and weight of camping gear. The separate nature of these items has also lead to campers inadvertently forgetting gear, and has caused individuals to forego the weight and trouble of carrying a pillow at all. It would therefore be desirable to provide an outdoor sleeping system whereby the entirety of the system may be packed as a single unit, but also may be adapted for use in accordance with various camping conditions as suggested above.

Another problem with conventional shelters relates to the difficulty in maintaining placement of a sleeping bag on the shelter's floor. This is particularly important where a simple moisture barrier is used, or where regions of the floor are to be reserved for purposes other than placement of the sleeping bag. It would therefore be desirable to provide an outdoor sleeping system whereby a sleeping bag may be secured to the system's floor in a predetermined position.

DISCLOSURE OF THE INVENTION

In accordance with our teachings, the present invention concerns a portable outdoor sleeping system of tent-like configuration, the system housing a sleeping bag which is detachably secured to a ground cover sheet. The system includes a shelter portion and a detachable ground cover sheet which serves as the system's floor portion (or floor).

The sleeping bag is fitted with an elongate perimeter flap to which a fastener element is fixed for use in securing the sleeping bag to the floor. The floor includes a sleeping bag outline flap which defines a predetermined sleeping bag placement position on the floor. The outline flap includes a fastener element which mates with the fastener element of the sleeping bag to removably secure the sleeping bag to the floor portion in the position defined by the outline flap.

According to a preferred embodiment of the invention, the system also includes one or more inflatable cushions, each formed of an air-impermeable material, and having a projecting strip which is secured to the floor.

The invented system thus may be packed as a single unit, including sleeping bags, pillows, and tent. Alternatively, individual portions of the unit may be packed or used independently so as to provide a more adaptable system than those currently known.

DETAILED DESCRIPTION OF THE PREFERRED EMBODIMENT AND BEST MODE FOR CARRYING OUT THE INVENTION

Figure 1:
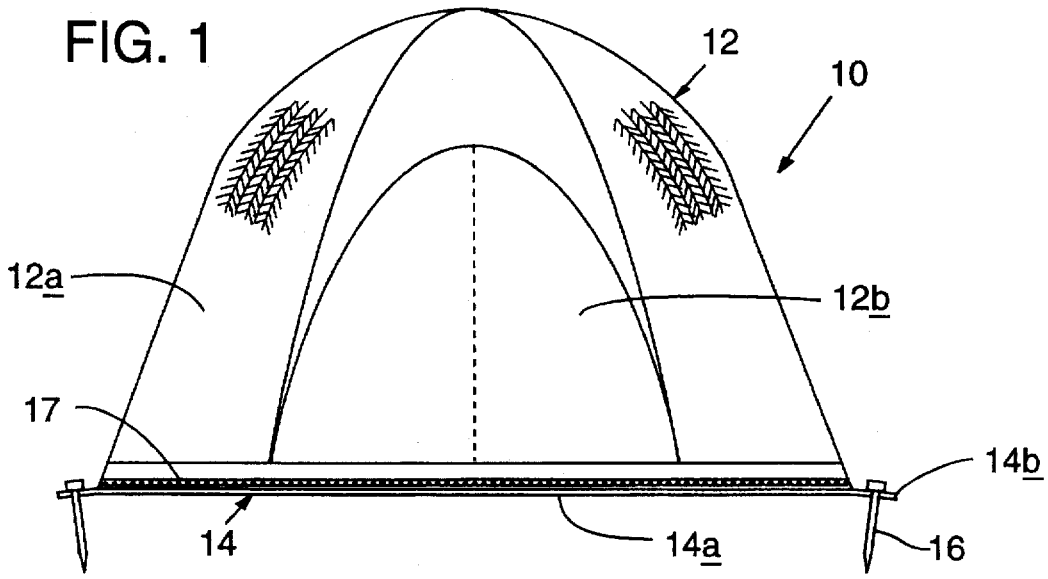
FIG. 1 is a front elevational view of an outdoor sleeping system constructed in accordance with the present invention, the system including a floor portion and a removable shelter portion so as to provide for varied system use.

Referring initially to FIG. 1, a preferred embodiment of the invented outdoor sleeping system is shown, the system being indicated generally at 10. The system takes the form generally of a tent or tent-like structure, the system including a shelter portion 12 and a correspondingly-shaped floor portion 14.

As indicated, the shelter portion is preferably dome-shaped, including a plurality of panel sections **12*a* collectively supported by a skeletal frame (not shown). One of the panel sections defines a door opening 12*b***, which may in turn include a pair of door flaps made closable using a zipper or the like. The shelter portion also may be formed with windows, screens or other amenities which have become well known to manufactures of tents and the like. Although the shelter portion is shown to be of a dome tent configuration, those skilled in the art will appreciate that virtually any style tent or shelter may be used.

The tent's floor portion takes the form of a thin, flexible ground cover sheet formed of a material which will provide an adequate moisture barrier between the ground and the interior of the tent. The ground cover sheet thus will be understood to conform substantially in shape and size to the footprint of the tent, including a central area **14*a* and a peripheral lip 14*b*. Lip 14*b* serves as a part of a ground securement mechanism, the lip defining holes 15 (FIG. 2) through which stakes 16 may be passed to secure the tent to the ground. Lip 14*b*** alternatively may take the form of simple loops, or may be omitted entirely where securement of the tent to the ground is not necessary.

In accordance with one of the advantageous features of the invention, it will be noted that the system's shelter portion is detachably secured to the floor via a fastener mechanism such as slide fastener 17 which extends perimetrically about the tent. In the preferred embodiment, the slide fastener takes the form of a zipper, but various alternative fastener arrangements similarly may be employed (i.e., buttons, snaps, straps) without departing from the spirit and scope of the invention as claimed. In the depicted embodiment, fastener 17 extends perimetrically about the base of the shelter portion (see FIG. 4) so as to provide for removal of the shelter portion from the floor without effect on the mechanism by which the floor is secured to the ground.

Figure 2:
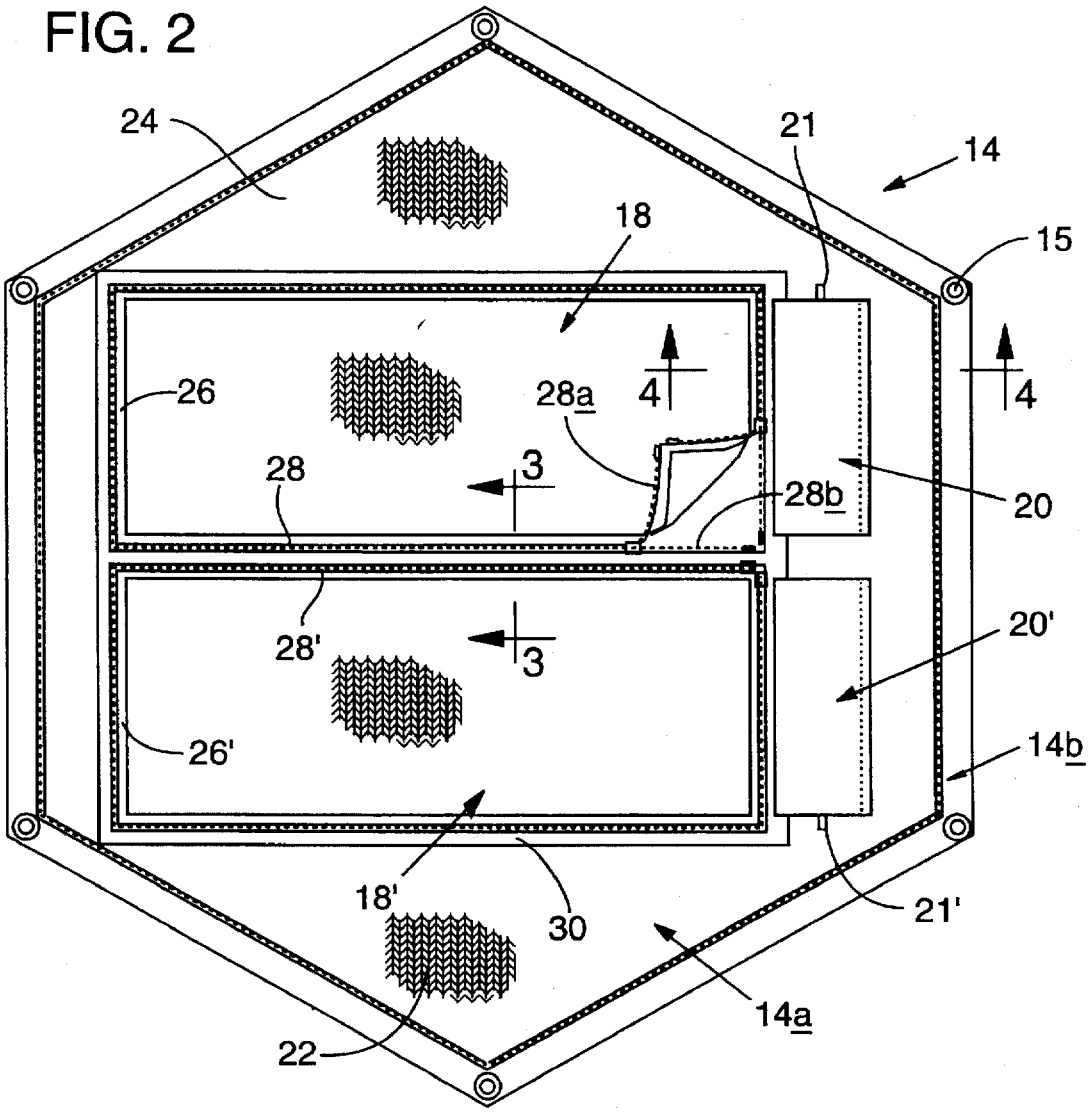
FIG. 2 is a somewhat schematic top plan view of the floor portion of the system depicted in FIG. 1, placement of a pair of detachable sleeping bags and corresponding pillows being illustrated therein.

FIG. 2 shows floor 14 in top plan view, the tent's shelter portion having been removed so as to illustrate the adaptable nature of the tent. As previously described, the floor consists of a thin, flexible ground cover sheet which will be understood to be adapted for placement thereon of one or more sleeping bags such as those shown at 18, 18'. The floor also may be adapted for placement thereon of inflatable cushions (or pillows) 20, 20'. In the preferred embodiment, the sleeping bags are removably attachable to the floor. The pillows, however, are shown permanently secured to the floor. Nevertheless, it will be understood that the pillows may be removably attached to the floor in a manner similar to the manner in which the sleeping bags are secured to the floor.

As indicated in FIG. 2, sleeping bags are detachably secured to the floor in predetermined sleeping bag placement positions, defining separate sleeping bag placement and gear storage regions on the floor. Gear storage regions 22, 24 are shown illustratively, each being left available for use in storing camping necessities (i.e., food, water, gear) other than the sleeping bags. Such controlled placement of sleeping bags is particularly beneficial in a small tent where storage space is especially sparse.

Figure 3:
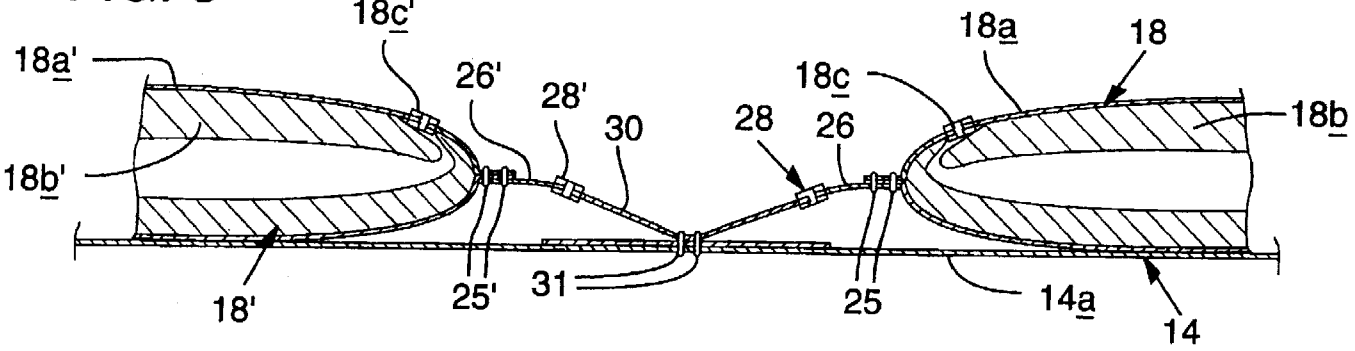
FIG. 3 is a sectional elevational view of the floor portion depicted in FIG. 2, the view being taken generally along lines 3—3 thereof.
Figure 4:
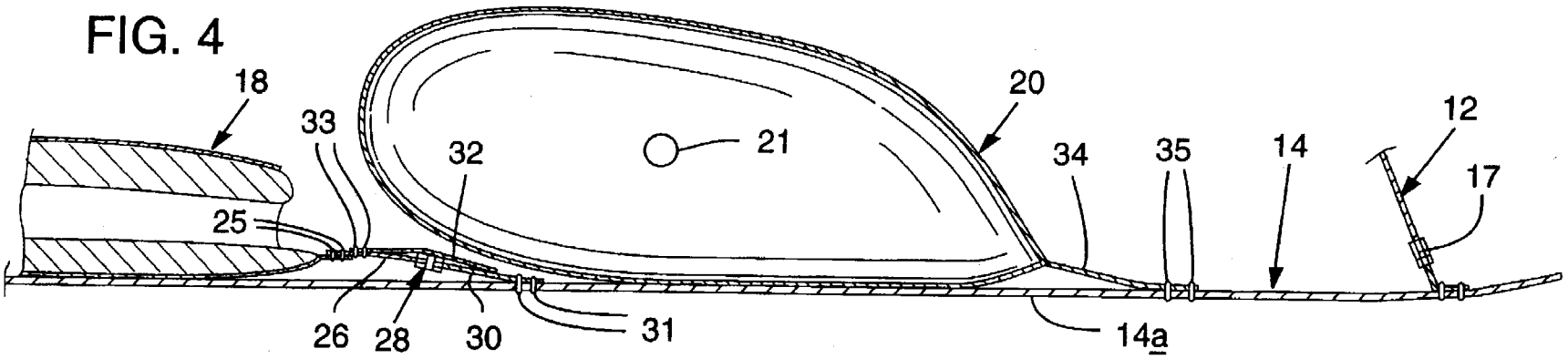
FIG. 4 is another sectional elevational view of the floor portion depicted in FIG. 2, the view being taken generally along lines 4—4 thereof.

FIGS. 3 and 4 illustrate that each sleeping bag preferably includes an outer shell 18*a*, 18*a'*, insulation 18*b*, 18*b'* and a closure mechanism 18*c*, 18*c'*. The depicted sleeping bags thus conform somewhat to conventional sleeping bag design. Although the sleeping bag is shown as including separate insulation and shell layers, an insulated outer shell may be used, such shell being formed, for example, from a material such as THINSULATE® so as to eliminate the need for additional insulation for the sleeping bags. Various other sleeping bag configurations may similarly be used without departing from the invention as defined by the claims.

Unlike conventional sleeping bags, sleeping bags 18, 18' each include an elongate perimeter flap 26, 26'. The perimeter flaps each extend substantially about the perimeter of a corresponding sleeping bag, and are fixed to the sleeping bags by suitable fastening means such as stitching 25, 25'. It is to be noted, however, that although stitching is illustrated and described herein for use in securing the flap to the sleeping bag, various other equally suitable fastening means may be used.

The ground cover sheet includes a sleeping bag outline flap 30 which is arranged generally to trace the outline of the sleeping bags to be used in the system. The sleeping bag outline flaps define the positions of the sleeping bags when secured to the floor. The outline flap is secured to the ground cover sheet by fastening means such as stitching 31. Various other equally suitable fastening means, however, may be used.

Included at the outermost edge of each perimeter flap is a fastening member such as slide element (or zipper element) 28*a*, such element extending substantially about the perimeter of the sleeping bag. A corresponding fastening member, such as slide element (or zipper) element 28*b* is secured to the innermost edge of the sleeping bag outline flap. The fastening members are adapted for mating relationship so as to provide for detachable securement of sleeping bag 18 to the ground cover sheet via a fastener arrangement generally indicated at 28. A similar fastener arrangement for use in securing sleeping bag 18' to the floor is identified in the drawings at 28'.

Inflatable cushions 20, 20' each include a flap 34 which is secured to the tent floor via stitching 35 as shown in FIG. 4. The pillows are inflatable through nozzles 21, 21' providing for a collapsible pillow which is fixed to the tent floor. Although illustrated as being permanently fixed to the tent floor, those skilled will appreciate that the pillow may be attached to the tent floor by mechanisms similar to that described with respect to the sleeping bags.

In the vicinity of pillows 20, fastener 28 is covered by a protecting flap 32 which in turn is secured to flap 26 by stitching 33 (see FIG. 4). This prevents puncture of the pillows by sharp edges on fastener 28 where a fastener such as a zipper is used. Pillow 20' is similarly secured to the floor and is protected by a similar protecting flap (not shown).

Although a preferred embodiment of the invention has been disclosed, it should be appreciated that variations and modification may be made thereto without departing from the spirit of the invention as claimed.

We claim:

1. A portable outdoor sleeping system comprising:

a sleeping bag having a closable shell with a perimeter flap to which a first slide fastener element is fixed; and a tent structure including a shelter portion and a ground cover sheet, said ground cover sheet being provided with a sleeping bag outline flap which includes second slide fastener element capable of mating relationship with said first slide fastener element to detachably secure said sleeping bag to said floor.

2. The outdoor sleeping system of claim 1 which further comprises an inflatable cushion formed of air-impermeable material and having a projecting strip secured to said ground cover sheet for fixing said cushion to said sheet.

3. The outdoor sleeping system of claim 1 which further comprises stakes, said ground cover sheet defining openings through which said stakes may be passed to removably secure said sheet to the ground.

4. The outdoor sleeping system of claim 1, wherein said ground cover sheet is detachably secured to said shelter portion via a parametric slide fastener.

5. A portable outdoor sleeping system which comprises:

a pair of elongate insulated sleeping bags, each having a closable shell with an elongate perimeter flap to which a first zipper element is perimetrically fixed; and a tent structure including a shelter portion and a detachable ground cover sheet, said ground cover sheet being provided with sleeping bag outline flaps which define predetermined sleeping bag placement positions, each outline flap including a second zipper element capable of mating relationship with one of said first zipper elements to detachably secure a corresponding one of said sleeping bags to said floor so as to define separate sleeping bag placement and a gear storage regions on said ground cover sheet.

* * * * *